United States Patent [19]

Colyer et al.

[11] Patent Number: 5,069,406

[45] Date of Patent: Dec. 3, 1991

[54] SURF BOARD SUPPORT AND PROTECTOR

[76] Inventors: Michael Colyer, 307 Madison Ave., Moorestown, N.J. 08057; Thomas Cucinotta, 702 Buttonwood La., Boynton Beach, Fla. 33436

[21] Appl. No.: 554,355

[22] Filed: Jul. 19, 1990

[51] Int. Cl.[5] ..... A45F 3/44

[52] U.S. Cl. ..... 248/156; 441/74; 114/361; 114/219

[58] Field of Search ..... 248/156, 176, 530, 545; 441/74; 114/361, 39.2, 343, 219

[56] References Cited

U.S. PATENT DOCUMENTS

| | | | |
|---|---|---|---|
| 2,652,999 | 9/1953 | Lohmar | 248/530 |
| 3,339,607 | 9/1967 | Howard | 441/74 X |
| 3,374,495 | 3/1968 | Joyce | 441/74 |
| 4,586,451 | 5/1986 | Mori | 114/219 |
| 4,955,314 | 9/1990 | Skedeleski | 441/74 X |

*Primary Examiner*—Carl D. Friedman
*Assistant Examiner*—Korie H. Chan
*Attorney, Agent, or Firm*—Simpson & Simpson

[57] ABSTRACT

A surf board support and protector made of semirigid to rigid material which is a poor conductor of heat, e.g. plastic, fiberglass or the like. The support has an internal cavity generally shaped to the nose end of a surf board. The support may be buried or forced into sand in a position to support a surf board in an upright position.

6 Claims, 2 Drawing Sheets

FIG. 4
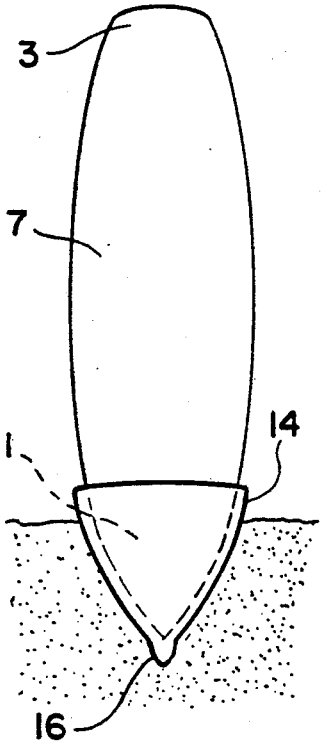
FIG. 5
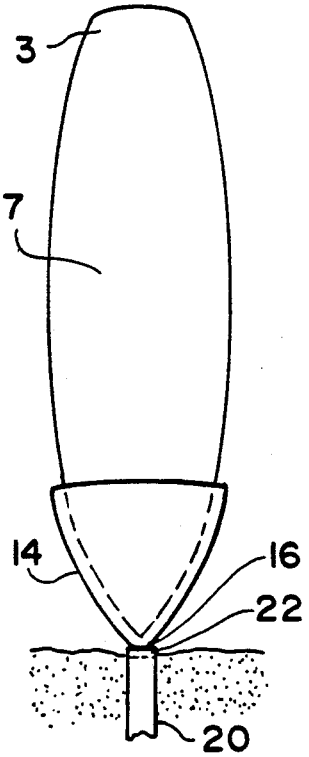
FIG. 6
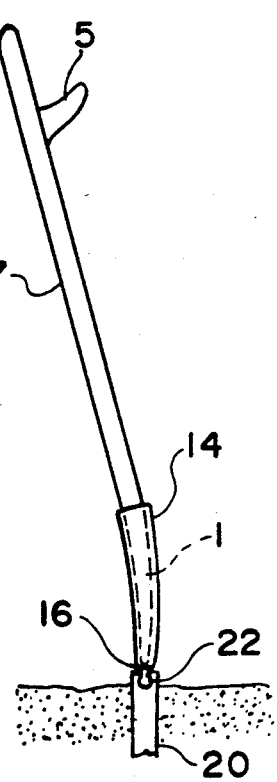
FIG. 7
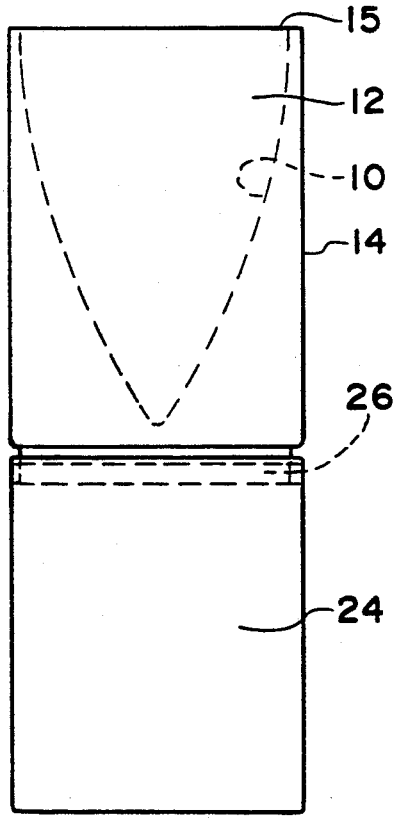
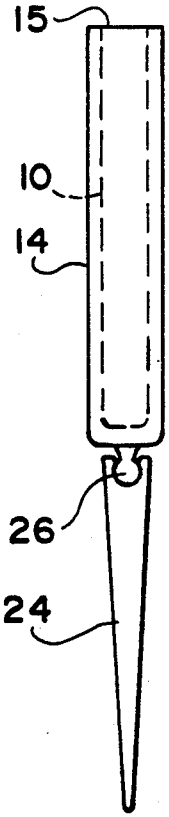
FIG. 8

SURF BOARD SUPPORT AND PROTECTOR

FIELD OF THE INVENTION

This invention relates to a surf board support for standing surf boards in hot sand or the like.

BACKGROUND OF THE INVENTION

Today's conventional surf board is manufactured from reinforced fiberglass and is carefully engineered and designed for maximum efficiency in the water. With the various improvements in the design and construction of surf boards, the purchase of such surf boards represents a substantial investment. In normal use, however, the surf boards are subjected to a variety of shocks, stresses and adverse physical conditions which significantly shorten the effective life of the surf boards.

In order to improve the surface of the surf boards, the top side of the surf board is generally covered with a wax which will create a tacky, yet soft surface to reduce the likelihood of the surfer sliding off of the board. The waxes used, however, are extremely sensitive to the sun. It is a common experience when the board is out of the water and resting on the beach to find that the sun melts the wax. Wind can blow sand and debris into the wax, and significantly impair the surface for the surfer. Laying the board top side down on the beach simply increases the surface area in contact with sand.

The practice has developed of standing the board upright in the sand as opposed to laying it down on the sandy beach, with the waxed side away from the sun and wind, thereby minimizing wax meltdown and sand being blown onto the principal surface of the board. Nevertheless, this requires that the nose of the surf board be pushed into or buried in the sand.

Repetitive thrusting of the nose of the surf board into the sand can cause substantial injury to the surf board through abrasion against the hot sand, shells, coral or any other objects buried in the sand, as well as any damage that may be imposed as a result of the force of pushing the nose of the surf board into the sand. A more serious problem, although not so readily apparent, is the effect of the hot sand on the general overall construction of a cold surf board. When a surfer leaves the water, the surf board is at a temperature approximately the same as the water temperature, which is well below the ambient air temperature. The sand, on the other hand, having been sun heated, is well above ambient air temperature. In general, the temperature differential between the sand temperature and the board temperature will be at least twenty degrees, and frequently is considerably higher. The stresses in the board can be compared to the stresses encountered when hot water is poured into a chilled glass, usually leading to the stress cracking of the glass. When the hot surf board is placed into contact with the hot sand, either by thrusting the cold board downward into the sand, or by burying a part of the upright board in the sand, substantial stress cracks occur, leading to deterioration and softening of the board materials including cracking and weakening of the fibers that were imbedded for strength. In time the board surface will crack sufficiently to cause leakage of water into the interior of the board during normal surfing operations.

BRIEF SUMMARY OF THE INVENTION

The present invention is a surf board support and protector made of semirigid to rigid material which is a poor conductor of heat, e.g. plastic, fiberglass or the like. The support has an internal cavity generally shaped to the nose end of a surf board. The support may be buried or forced into sand in a position to support a surf board in an upright position. As used herein, the term "upright position" with regard to a surf board is referring to the nose down towards the sand, and the tail area region of the surf board high. The internal cavity should be sufficiently smooth, even slippery, that the surf board is able to be taken in and out of the support without sticking. The support should have sufficient surface area buried in the sand to hold the surf board upright when it is resting in the concavity, or should be provided with an extended surface to be buried in the sand.

BRIEF DESCRIPTION OF THE DRAWINGS

FIG. 4 is a front elevational view of the support and protector of the present invention in operative use.

FIGS. 5 and 6 are front and side elevations of another modification of the present invention particularly adapted to permit adjustable positioning of the surf board.

FIGS. 7 and 8 are front and side elevations of still another adjustable embodiment of the present invention.

DETAILED DESCRIPTION OF THE INVENTION

Figure 1:
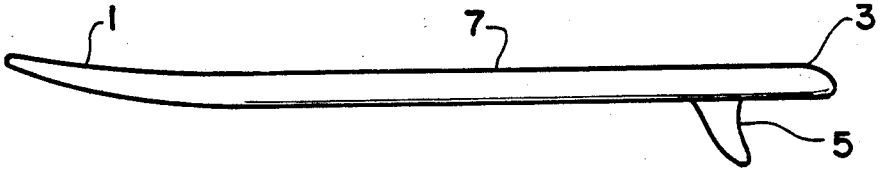
FIG. 1 is a typical surf board.

FIG. 1 illustrates a typical surf board having a nose portion 1 and end portion 3 and a skeg 5. The surfer normally stands on the surface 7. When a surfer completes his ride, it is common for the surfer to insert forcibly the nose portion 1 of the surf board into the sand a sufficient distance so that the board will remain in a generally standing position. The support and protector of the present invention is designed to minimize damage both to the nose of the surf board due to the abrasive effects of sand and the impact stresses, but also to protect the board from the thermal shock resulting from the difference in temperature from the surf board freshly out of the water and the hot sand.

Figure 2:
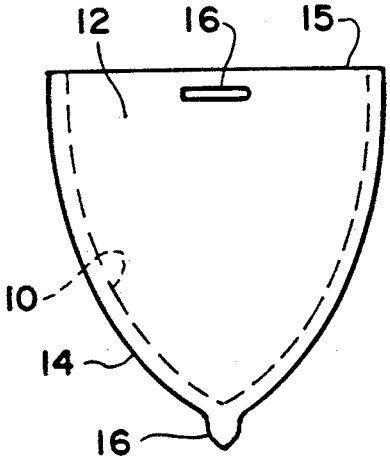
FIG. 2 is a front elevation of one version of the invention.

The support and protector of the present invention as shown in its preferred embodiment in FIG. 2 overcomes these difficulties encountered in the past. The embodiment in FIG. 2 can generally be considered as a single-wall member 10 of generally uniform thickness formed to define an inner cavity 12 as represented by the region between the broken lines in FIG. 2 and an outer surface 14. The embodiment terminates in a wedge portion 16. The inner cavity 12 opens to the exterior at the top of the support at 15. A suitable opening 16 is provided in each face of the support for use as hand grips or tie-down spots.

Figure 3A:
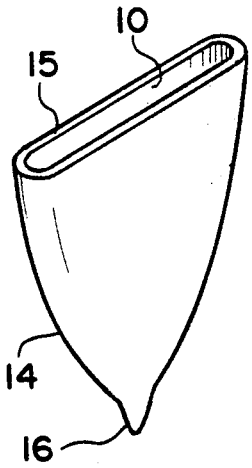
FIGS. 3*a*, 3*b*, and 3*c* presents three possible perspective views for the versions of the invention shown in FIG. 2.
Figure 3B:
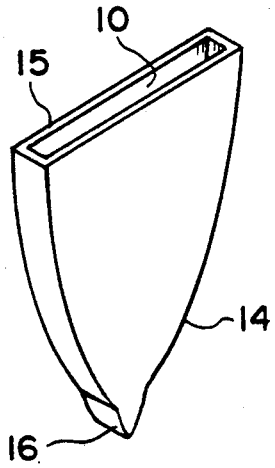
Figure 3C:
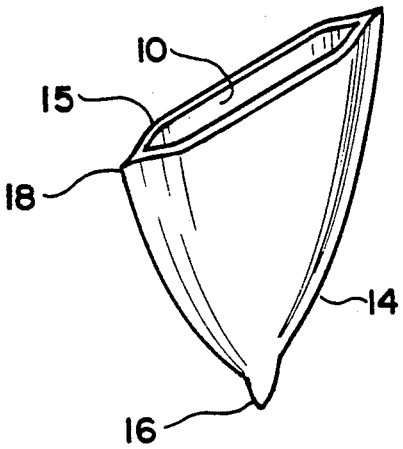

FIGS. 3*a*, 3*b*, and 3*c* provides three alternative perspective views of the embodiment of FIG. 2. In the embodiment of FIG. 3A, the lower end portions of the support member all taper to the same general region defining generally a point as the wedge portion 16. The outer extremity 14 of the embodiment of FIG. 3A will generally be rounded or curved much as in the manner that the edges of a surf board are curved and rounded.

In the embodiment of FIG. 3B, the sides 14 are generally flat until they reach region 16 at which point they terminate in a true wedge.

In the embodiment of FIG. 3C, the front and back faces of the embodiment of FIG. 2 taper in towards each other defining in effect a line or seam 18. In the case of the embodiment of FIG. 3C, the wedge portion is pyramidal.

Whatever the final shape, the support and protector of the present invention must have sufficient external surface for burying in the sand as to resist bending moments and other forces and stresses which tend to cause the support to pull out of the sand when a surf board of FIG. 1 is in place. This is illustrated in FIG. 4.

For a support that conforms in its external design to the same general shape as the nose of the surf board itself, a length of about one foot is the minimum that will provide reasonable support for a surf board. The preferred embodiments, as shown in FIGS. 2 and 3, are approximately seventeen to eighteen inches in length with the expectation that at least sixteen inches of that surface will be imbedded in the sand. It is not necessary, however, that the external surface be designed to the same general design as a surf board nose, although that is a convenient and preferred form. Any surface which would be sufficient to anchor in the sand and resist pulling out of the sand when containing a surf board would be appropriate.

The internal cavity of the support is critical in design. If the internal cavity is provided with sufficient lubricity, the cavity may conform almost identically to the nose of the surf board. That is the preferred embodiment. The lubricity is necessary to permit easy insertion and removal of the surf board without the necessity for continually replanting the support each time the surf board is removed from the sand. Typically, most of the available plastics, particularly the waxy plastics such as polyethylene and polypropylene will provide such lubricity. However, if this high degree of lubricity is not maintained, then the internal cavity should be modified with smooth ridges or bumps to minimize contact between the board and the side walls of the support cavity, and thereby minimize the frictional drag that would tend to pull the support out of the sand when the board is removed. Care must be exercised, however, to be certain that the "ridges" and "bumps" do not cause the board to wedge tightly into the cavity.

As long as the internal cavity 12 permits insertion of the board and otherwise meets the requirements as set forth in the preceding paragraph, the precise dimensions of the internal cavity are not critical. For illustration purposes, a typical internal cavity for the support of the present invention, as illustrated by the broken lines in FIGS. 2 and 3, would have the following profile. With regard to FIG. 2, measuring up from the lowest point 16 that would be plunged into the sand, the internal cavity would be approximately one to one and one-half inches across at a distance about one and one-half inches up from the bottom point; approximately six inches across at a distance about four inches up from the point; approximately ten to eleven inches across at a distance about eight inches up from the point; approximately fourteen inches across at a distance about twelve inches up from the point; approximately seventeen inches across at a distance about sixteen inches up from the point; and approximately eighteen inches across at a distance about eighteen inches up from the point.

In all of the embodiments shown in FIG. 3, the internal cavity is approximately three to four inches in width with the sides 10 of the internal cavity 12 running generally parallel to each other.

FIGS. 5 and 6 provide another embodiment of the invention. In this case, the support must be generally configured as described previously, except that its primary function is to encompass and hold the board in the upright position, not to press it against the sand. Instead, there is mounted to the tip 16 of the support a support rod 20 or other support base for imbedding in the sand while the main body of the support is above the sand. The point of juncture of this support rod with the support portion may be a swivel 22 which is normally frictionally engaged to resist movement when the board is in place, but which, by the additional application of pressure by the surfer, will permit movement of the upper surface relative to the support rod below the surface of the sand. In this way, the surfer can adjust the angle of the surf board support and surf board in the support mechanism as the sun changes position during the course of the day and thereby optimize the position of the waxed surface of surf board relative to the sun.

A similar modification is shown in the embodiment of FIGS. 7 and 8. In this case, the connection between the surf board support and the mechanism and the bracing part 24 that goes below sand level are joined by a hinged area 26, rather than a swivel. Again, however, this allows the surfer to choose the optimum angle for the board given the surrounding sun and air conditions. In this case, the lower portion to go into the sand, 24, is wedge-shaped to increase the ease of placing the device in the sand.

Figure 9:
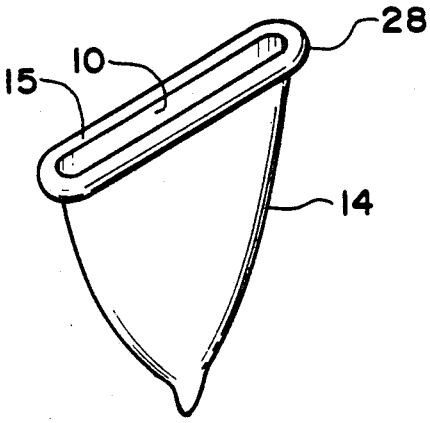
FIG. 9 is a perspective view of an embodiment of the present invention in which the device is provided with an extended upper surface or "wings".

The embodiment shown in FIG. 9 is provided with an extended lip or flange, 28. This could also take the form of wings to increase the ease of placement of the device in the sand. The extended wings or flange provide a place to position the surfer's foot, similar to the upper part of a spade, so that force may be exerted with the foot to force or drive the support into the sand.

The particular materials of construction are not generally critical other than the fact that they should be the type of materials that will not readily conduct heat, should provide a reasonable degree of lubricity in the internal cavity, and should have sufficient rigidity to be able to be placed in the sand and support the board when it is placed therein without collapse of the support when the board is in place or when it is removed. Flexible materials would, of course, be unsuitable and preferred materials are rigid although semi-rigid materials may also be used. Obviously, metal and other heat conductors would be unsuitable.

The support of the present invention can additionally be useful when carrying the surf board on an automobile hard top carrier. The nose of the surf board can be protected during such occurrences by simply strapping or taping the nose piece in place on the nose of the board so that any impacts on the surf board during travel will affect only the inexpensive support and not the surf board itself. Other uses and embodiments of the invention will be apparent from the disclosure, drawings, and appended claims.

What is claimed is:

1. A surf board support and protector, said support and protector comprising an internal surface and an external surface, said internal surface defining an internal cavity conforming generally to the shape of the nose portion of a surf board and open at its broadest point for insertion of and receipt therein of the nose portion of a surf board, said external surface of size and configuration to contain said internal cavity and terminating in a wedge configuration in the region of said support and protector in closest proximity to the narrowest portion of said internal cavity, said wedge configuration adapted to be driven into said with the open portion of said cavity above the surface of said sand, said surf board support and protector being constructed of material which is semi-rigid and which is a poor conductor of heat, said internal surface characterized as nonbinding on a surf board when a surfboard is inserted fully into the internal cavity defined by said internal surface.

2. A surf board support and protector in accordance with claim 1 in which said internal surface and said external surface are defined by a single common wall formed by the molding of said support and protector from a polymeric material by unitary molding means.

3. A surf board support and protector in accordance with claim 1 in which the terminal wedge configuration comprises a main support piece and a separate wedge piece pivotably mounted and affixed to the main support piece by a pivot or hinge means requiring the application of force, in excess of those forces normally encountered when said surf board support and protector is supporting a surf board, to enable pivoting of said main support piece relative to said separate wedge piece.

4. A surf board support and protector, said support and protector comprising an internal surface and an external surface, said internal surface defining an internal cavity conforming generally to the shape of the nose portion of a surf board and open at its broadest point for insertion of and receipt therein of the nose portion of a surf board, said external surface of size and configuration to contain said internal cavity and terminating in a wedge configuration in the region of said support and protector in closest proximity to the narrowest portion of said internal cavity, said wedge configuration adapted to be driven into sand with the open portion of said cavity above the surface of said sand, said surf board support and protector being constructed of material which is rigid and which is a poor conductor of heat, said internal surface characterized as nonbinding on a surf board when a surfboard is inserted fully into the internal cavity defined by said internal surface.

5. A surf board support and protector in accordance with claim 4 in which said internal surface and said external surface are defined by a single common wall formed by the molding of said support and protector from a polymeric material by unitary molding means.

6. A surf board support and protector in accordance with claim 4 in which the terminal wedge configuration comprises a main support piece and a separate wedge piece pivotably mounted and affixed to the main support piece by a pivot or hinge means requiring the application of force, in excess of those forces normally encountered when said surf board support and protector is supporting a surf board, to enable pivoting of said main support piece relative to said separate wedge piece.

* * * * *